US006767235B2

(12) United States Patent
Wu

(10) Patent No.: US 6,767,235 B2
(45) Date of Patent: Jul. 27, 2004

(54) ELECTRICAL CONNECTOR HAVING RETENTION SYSTEM FOR MOUNTING ONTO A PRINTED CIRCUIT BOARD

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 15 days.

(21) Appl. No.: 10/206,287

(22) Filed: Jul. 26, 2002

(65) Prior Publication Data

US 2004/0018766 A1 Jan. 29, 2004

(51) Int. Cl.[7] ..... H01R 13/62
(52) U.S. Cl. ..... 439/328; 439/569; 439/79
(58) Field of Search ..... 439/327, 573, 439/79–81, 547, 562, 567, 680

(56) References Cited

U.S. PATENT DOCUMENTS 5,160,275 A * 11/1992 Nakamura et al. ..... 439/328
5,230,633 A * 7/1993 Hisatomi et al. ..... 439/79
5,709,555 A * 1/1998 Noschese ..... 439/79
5,823,799 A * 10/1998 Tor et al. ..... 439/79
5,980,273 A * 11/1999 Yong et al. ..... 439/79
5,993,263 A * 11/1999 Sampson ..... 439/660
6,068,501 A * 5/2000 Knighton et al. ..... 439/328

* cited by examiner

*Primary Examiner*—Hien Vu
(74) *Attorney, Agent, or Firm*—Wei Te Chung

(57) ABSTRACT

An electrical connector (1) includes an insulative housing (10) for being mounted to an edge of a printed circuit board (6) and a plurality of contacts (12) received in recesses (20) defined in the insulative housing. The insulative housing has an elongated body portion (14), a mating portion (18) projecting forwardly from the body portion and a pair of guide portions (16) formed on a pair of lateral sides of the body portion. A pair of first retainers (40) respectively extends rearwardly from the body portion. The first retainer comprises a top latch (42) and a bottom latch (44) and a receiving slot (43, 53) defined between the top and bottom latches. A plurality of locking tabs (45) is formed on the bottom latch and extending into the receiving slots. The latches of the retainers can fix the PCB tightly and keep the PCB and the electrical connector steadily assemble together.

8 Claims, 10 Drawing Sheets

ELECTRICAL CONNECTOR HAVING RETENTION SYSTEM FOR MOUNTING ONTO A PRINTED CIRCUIT BOARD

CROSS-REFERENCES TO RELATED APPLICATIONS

This patent application is a Co-pending Application of patent application Ser. No. 09/938,442, entitled "ELECTRICAL CONNECTOR HAVING GROUNDING BRIDGES"; Ser. No. 10/159,412, entitled "ELECTRICAL CONNECTOR HAVING RETENTION SYSTEM FOR MOUNTING ONTO A PRINTED CIRCUIT BOARD", all invented by the same inventors as this patent application and all assigned to the same assignee.

FIELD OF THE INVENTION

The present invention relates to an electrical connector, and particularly to an electrical connector having a retention system for facilitating mounting of the electrical connector to a printed circuit board.

DESCRIPTION OF RELATED ART

It is well known to provide an electrical connector mountable to a printed circuit board (hereinafter PCB), in which the connector has terminals electrically engaging with respective electrical circuit traces on the PCB. The terminals may have solder tails projecting from the connector and inserted into holes in the PCB, or leg portions extending generally parallel to the PCB for surface mounting to circuit traces on the PCB. Such a connector has a problem that the electrical connections between the terminals and the circuit traces of the PCB often are subjected to external stresses, which sometimes will cause the solder tails or the leg portions of the connector separating electrically connects with the PCB. To resolve this problem, U.S. Pat. Nos. 5,622,519, 5,217,381, 5,230,633, 5,178,557 and 4,679,883 disclose the use of board locks and posts to retain the connectors to the printed circuit boards.

However, with the ever-increasing miniaturization of electronic circuit, along with the consequent reduction in sizes of the connector and terminals, the board locks are often impractical and neither cost nor space effective.

Regarding the posts, which extend vertically from the dielectric housing of the electrical connector for insertion into the printed circuit board, the posts result in a difficulty in molding the housing. Because the housing has generally a mating port extending along a horizontal direction, a mold open direction of the mold for forming the housing His in a horizontal direction. To form the vertically extending posts, slide structure is necessary in the mold. The slide structure increases the cost and operating complication of the mold. Furthermore, for a board edge mounting electrical connector, a mating/unmating force of the connector will cause the connector to rotate, whereby the connections of the tails of the connector and the PCB are insecure. Hence, an improvement to resolve the problems of the prior art is required.

SUMMARY OF THE INVENTION

Accordingly, the object of the present invention is to provide an electrical connector for facilitating mounting of the electrical connector onto a PCB.

In order to achieve the object set forth, an electrical connector includes an insulative housing for being mounted to an edge of a printed circuit board and a plurality of contacts received in recesses defined in the insulative housing. The insulative housing has an elongated body portion, a mating portion projecting forwardly from the body portion and a pair of guide portions formed on a pair of lateral sides of the body portion. A pair of first retainers and a second retainer respectively extends rearwardly from the body portion. The first retainers are adjacent to the guide portions and the second retainer locates between both first retainers. Each retainer respectively comprises a top latch and a bottom latch, and a receiving slot is defined between the top and bottom latches. A plurality of locking tabs is formed on the bottom latch and extending into the receiving slot. The latches of the retainers can fix the PCB tightly and keep the PCB and the electrical connector steadily assemble together.

Other objects, advantages and novel features of the invention will become more apparent from the following detailed description when taken in conjunction with the accompanying drawings.

DETAILED DESCRIPTION OF THE INVENTION

Figure 1:
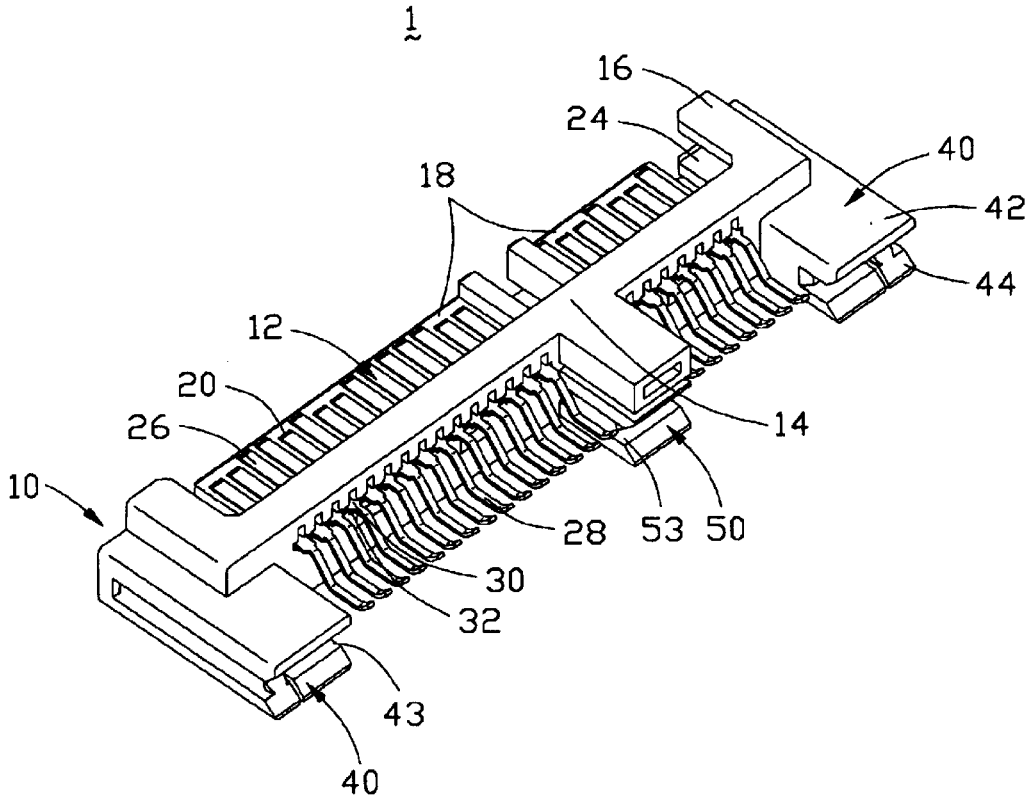
FIG. 1 is a top perspective view of an electrical connector in accordance with the present invention.
Figure 2:
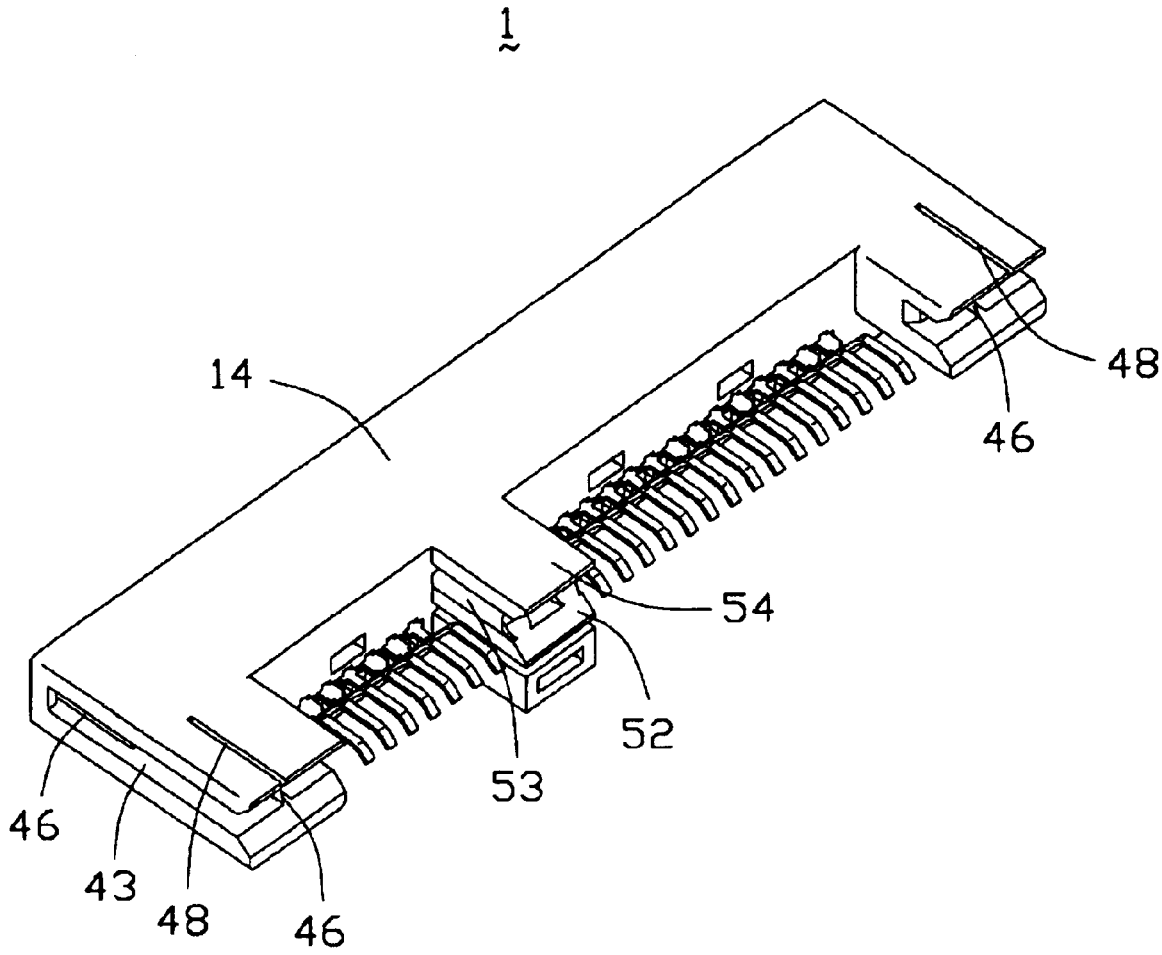
FIG. 2 is a bottom perspective view of the electrical connector of FIG. 1.
Figure 5:
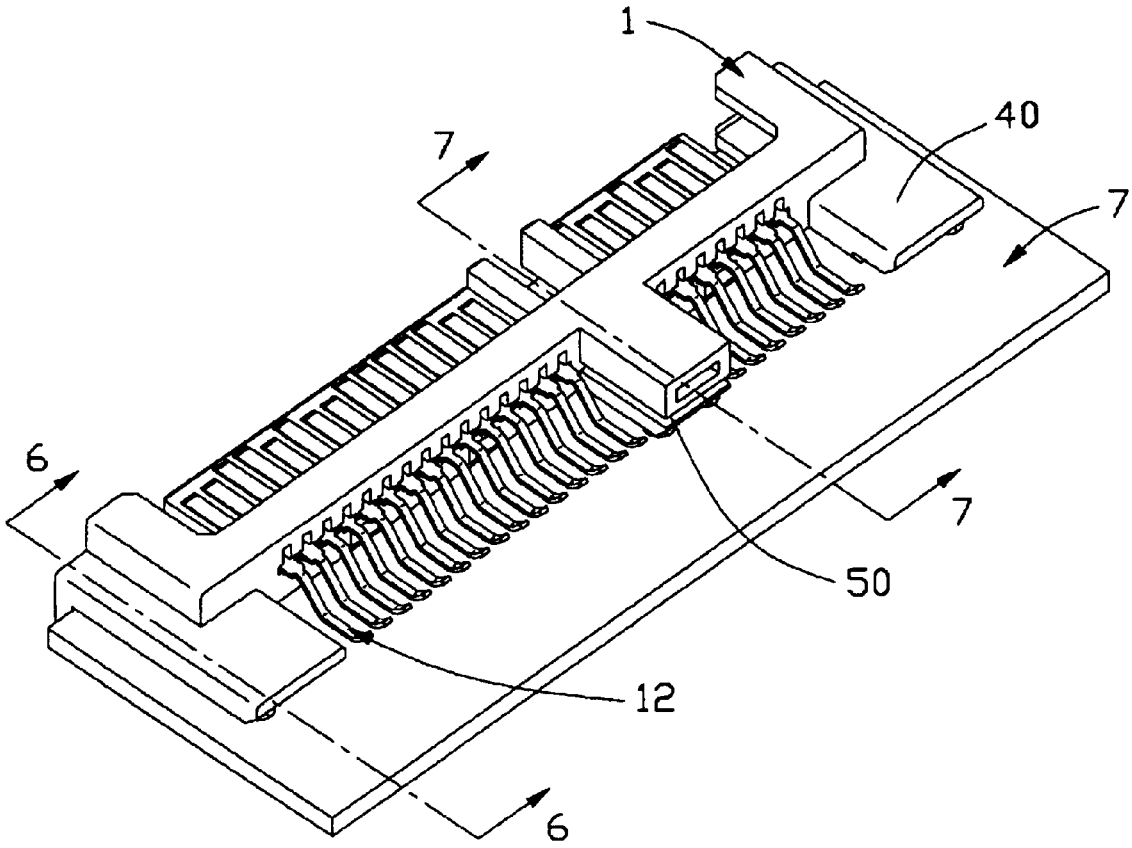
FIG. 5 is a top perspective view of the electrical connector in accordance with the present invention assembled onto a printed circuit board (PCB)
Figure 6:
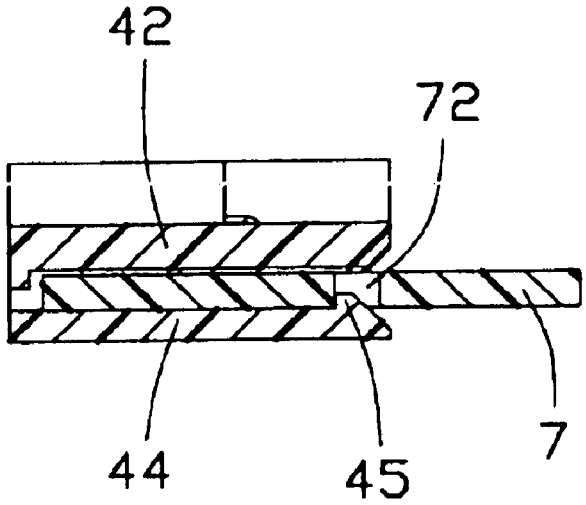
FIG. 6 is a cross-sectional view of the electrical connector taken along line 6—6 of FIG. 5 with contacts of the connector removed to facilitate the illustration.
Figure 7:
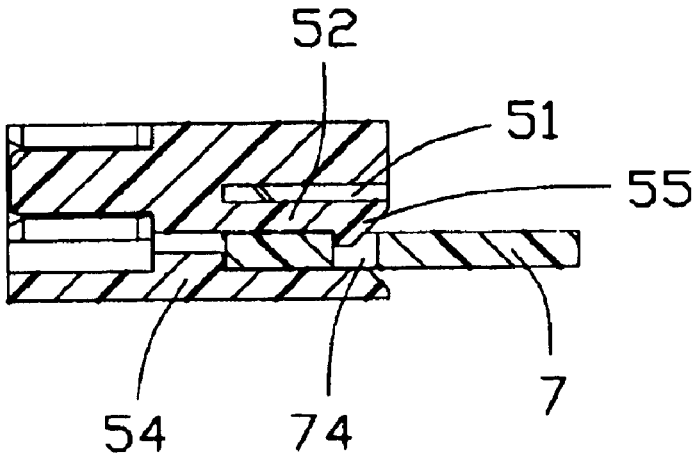
FIG. 7 is a cross-sectional view similar to FIG. 6 but taken along line 7—7 of FIG. 5.
Figure 8:
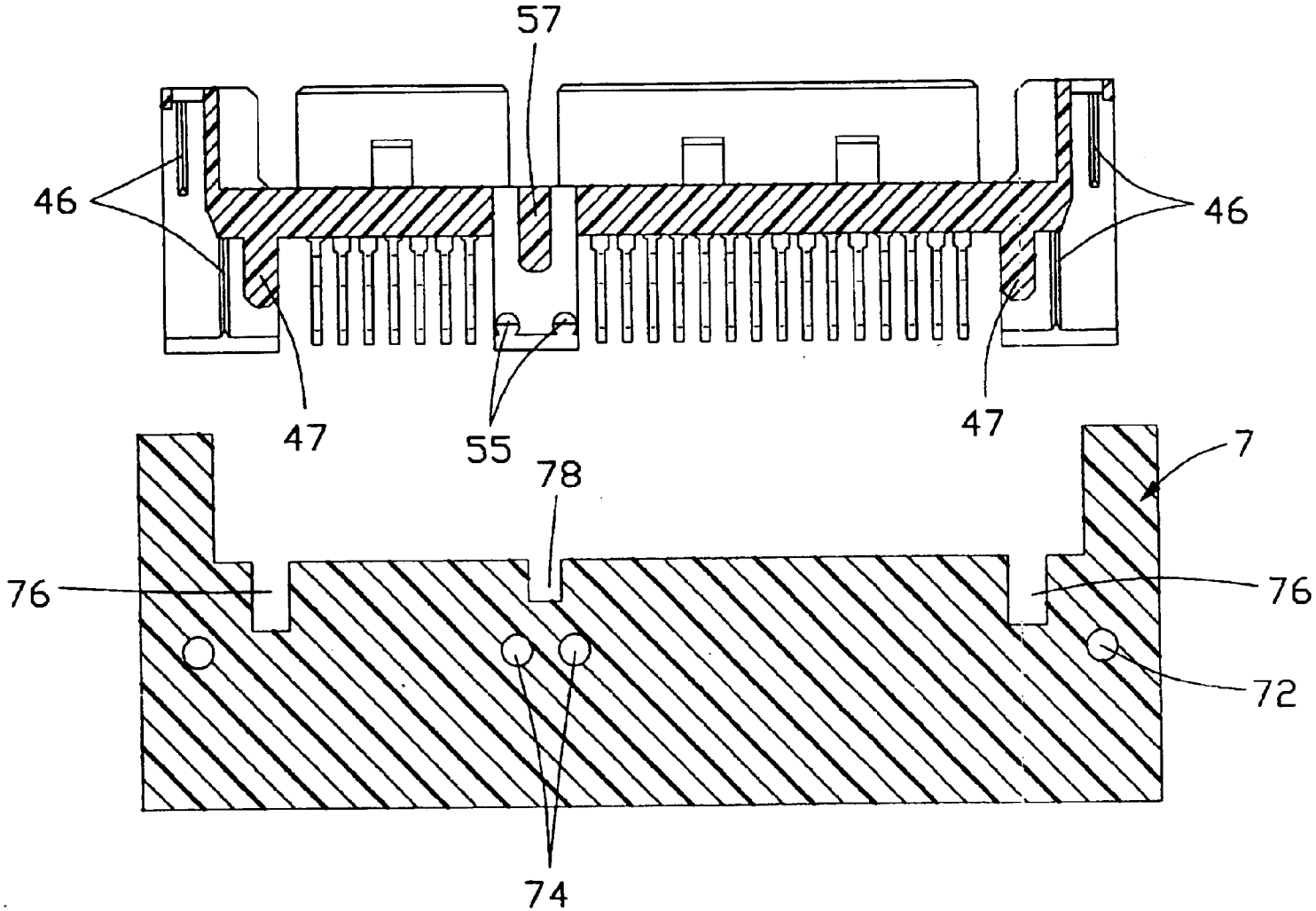
FIG. 8 is a top cross-sectional view of the connector with the PCB taken along line 8—8 of FIG. 3 to show the electrical connector without being assembled to the PCB.
Figure 9:
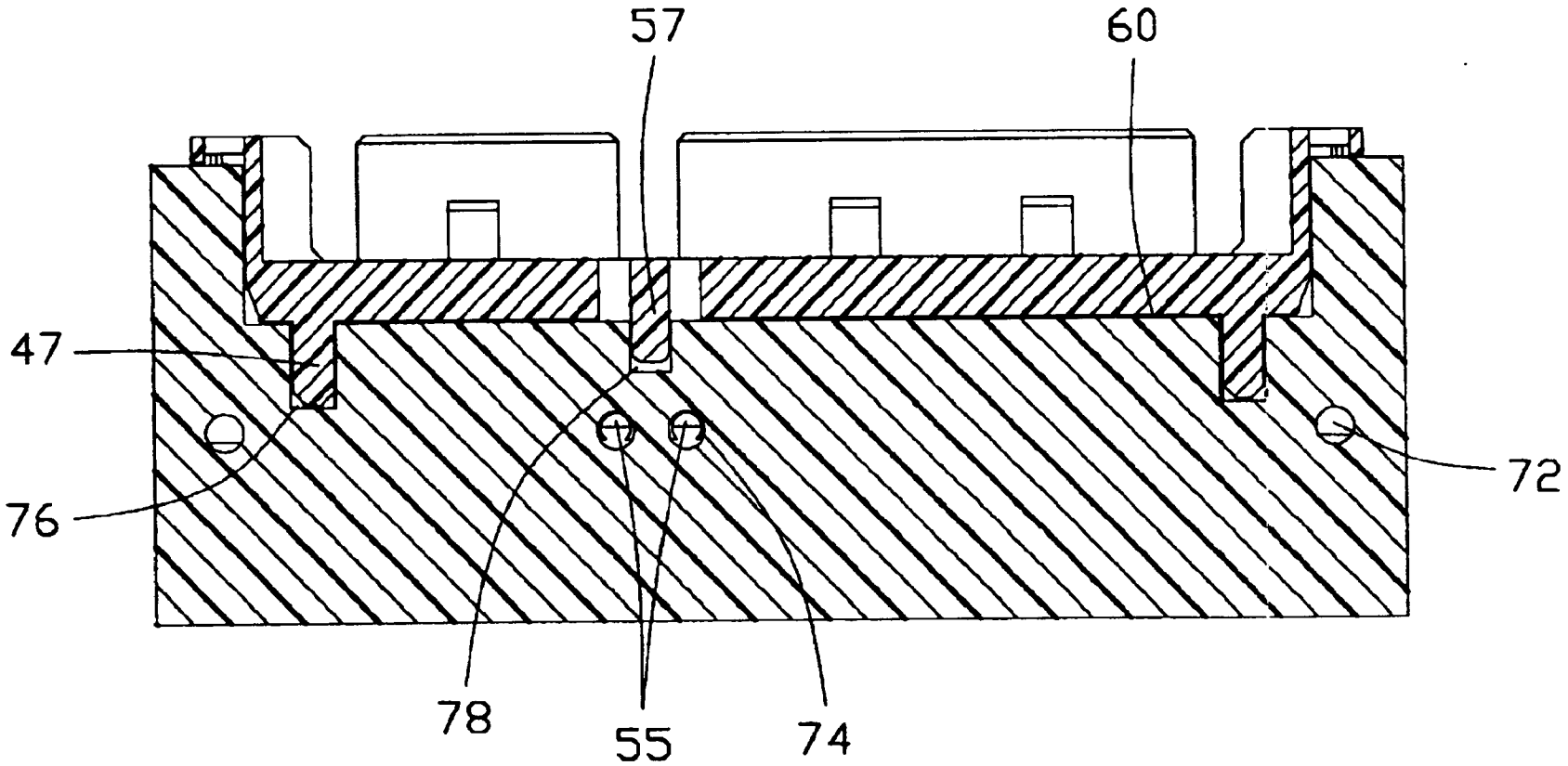
FIG. 9 is a view similar to FIG. 8 with the electrical connector assembled to the PCB.
Figure 10:
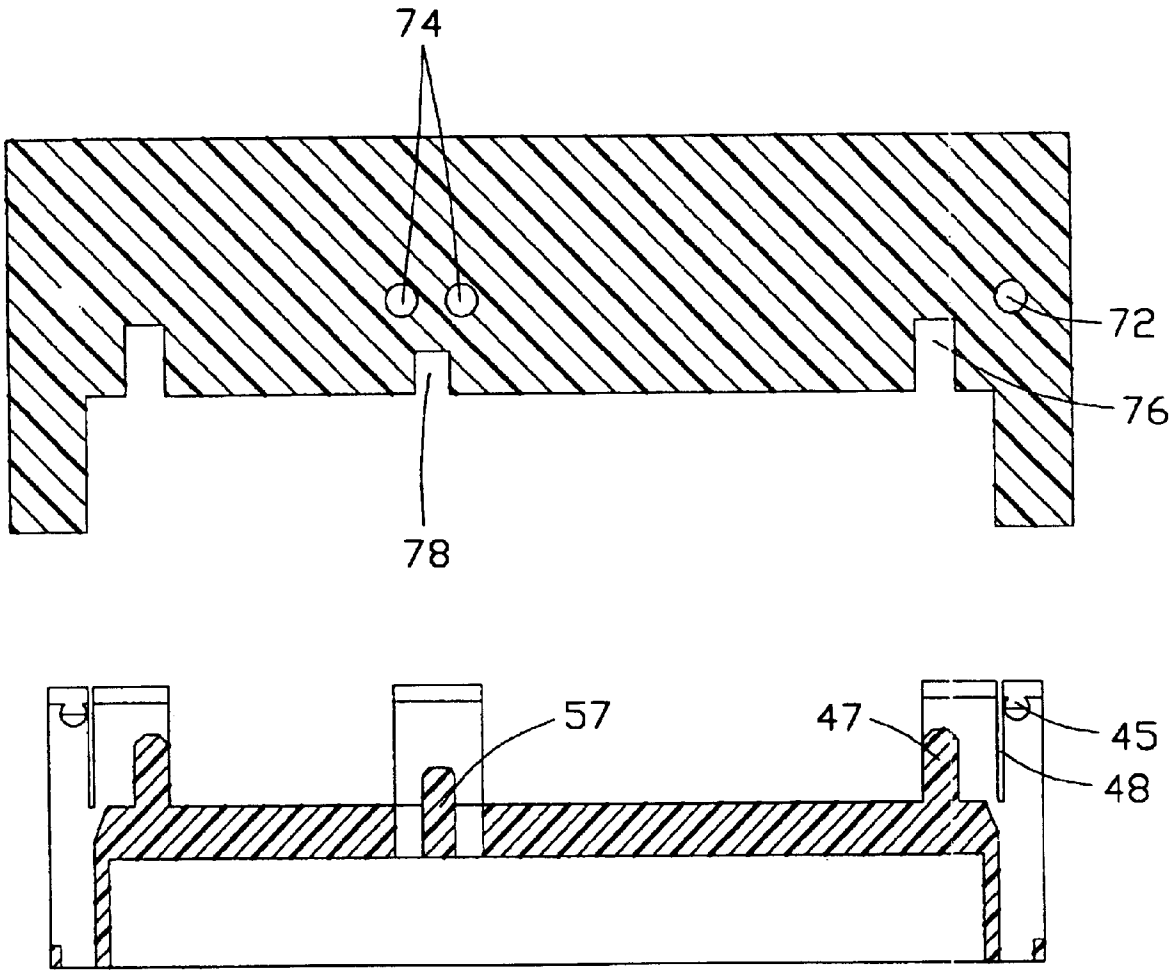
FIG. 10 is a bottom cross-sectional view of the connector and the PCB but taken along line 10—10 of FIG. 3.
Figure 11:
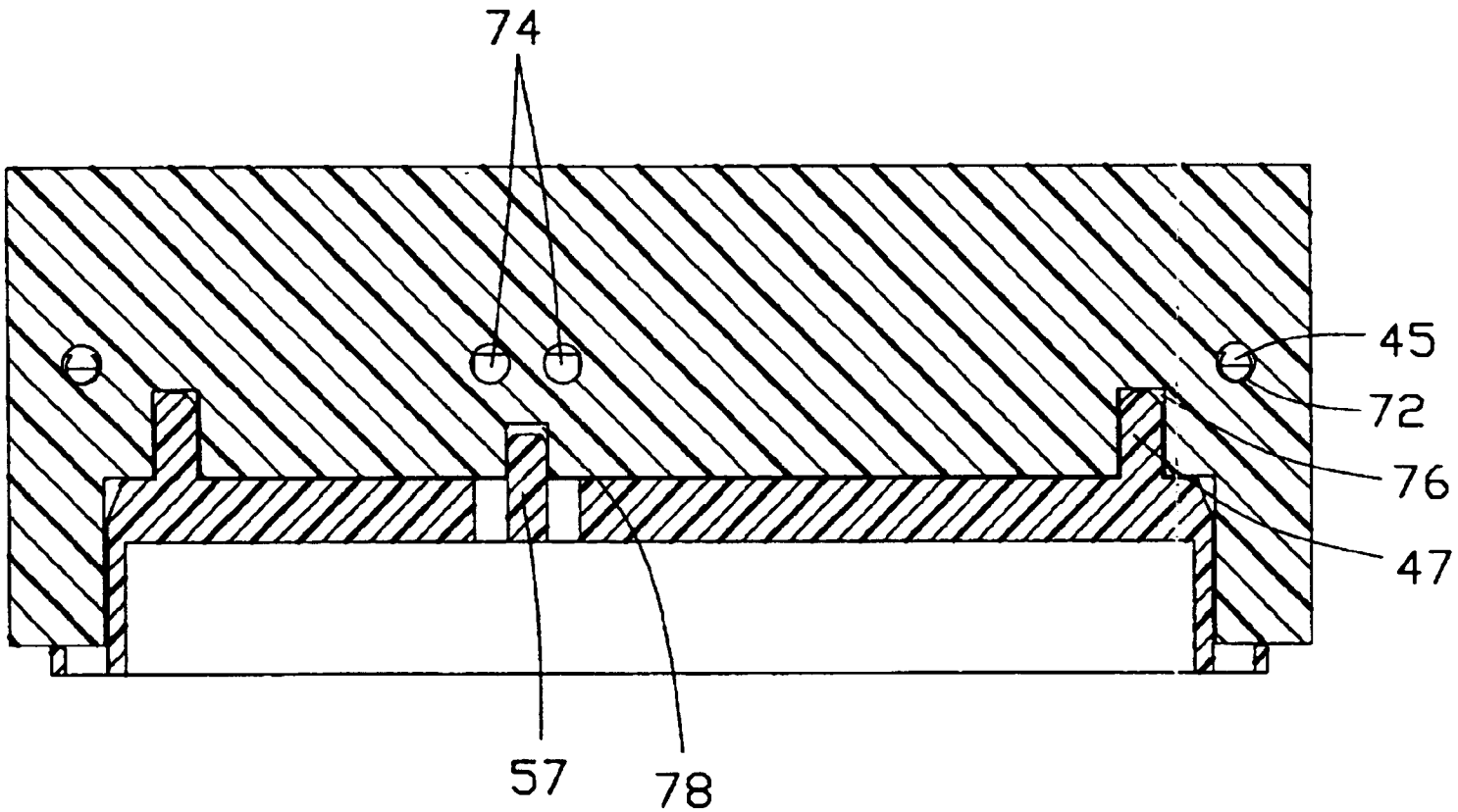
FIG. 11 is a view similar to FIG. 10 with the electrical connector assembled to the PCB.

Referring to FIGS. 1 and 2, an electrical connector 1 of the present invention for being mounted to a printed circuit board (PCB) 7 (shown in FIG. 5) comprises an insulative housing 10 and a plurality of contacts 12 received in the insulative housing 10. The insulative housing 10 has an elongated body portion 14 and a pair of guide portions 16 projecting forwardly from a pair of ends of the body portion 14. Two mating portions 18 project forwardly from the body portion 14 for engaging with a complementary connector (not shown). A plurality of recesses 20 is defined in each of the mating portions 18 for receiving the contacts 12. Along the mating direction, each of guide portions 16 defines a guiding channel 24. The body portion 14 also has a rear face 60 (referring to FIG. 3) which can stop the PCB 7 further inserted (referring to FIG. 9).

The contacts 12 each includes a contact portion 26 in a respective recess 20 of the mating portions 18 and a tail portion 28 projecting rearwardly of the body portion 14 for electrically engaging with the PCB 7 to transfer and receive signals to/from circuit traces (not labelled) on the PCB 7. In addition, a retaining portion 30 with a pair of teeth 32 is disposed between the contact portion 26 and the tail portion 28, and engages in the body portion 14.

Figure 3:
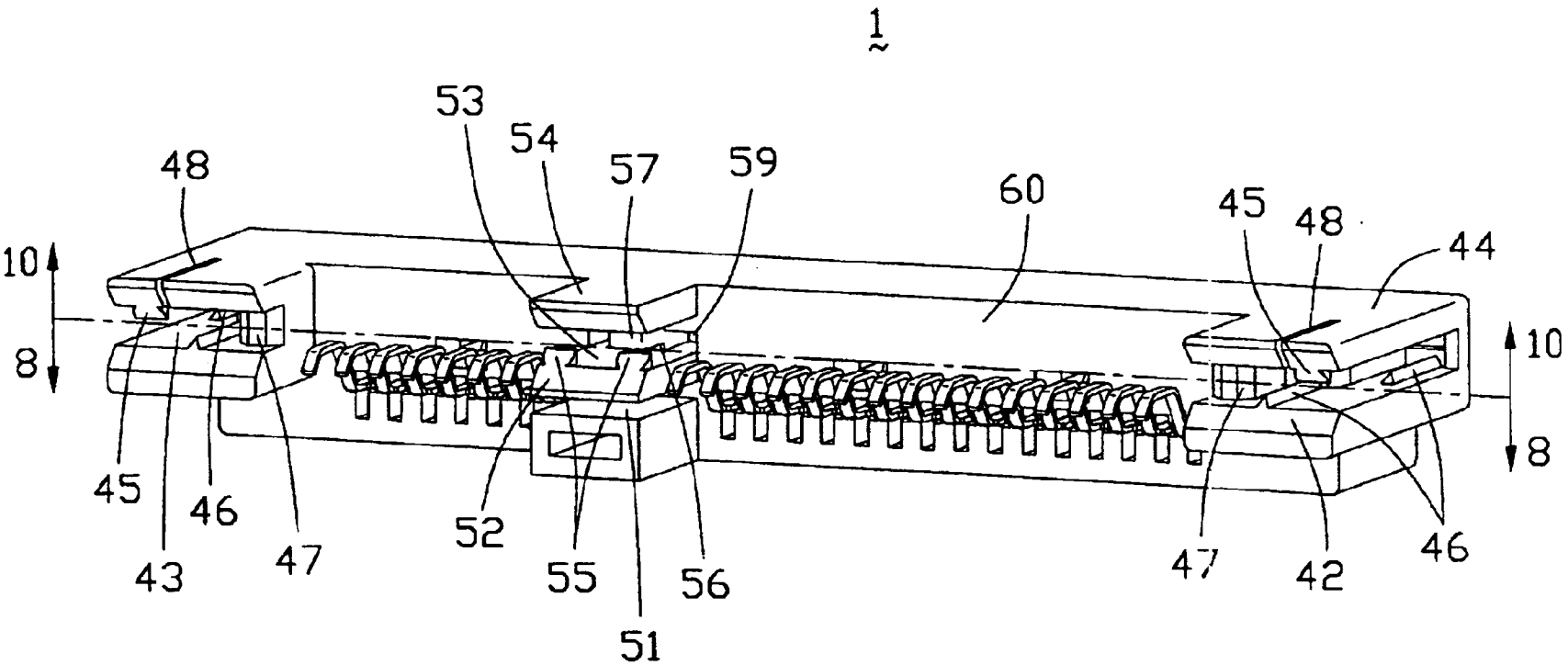
FIG. 3 is a rear perspective view of the electrical connector of FIG. 1.
Figure 4:
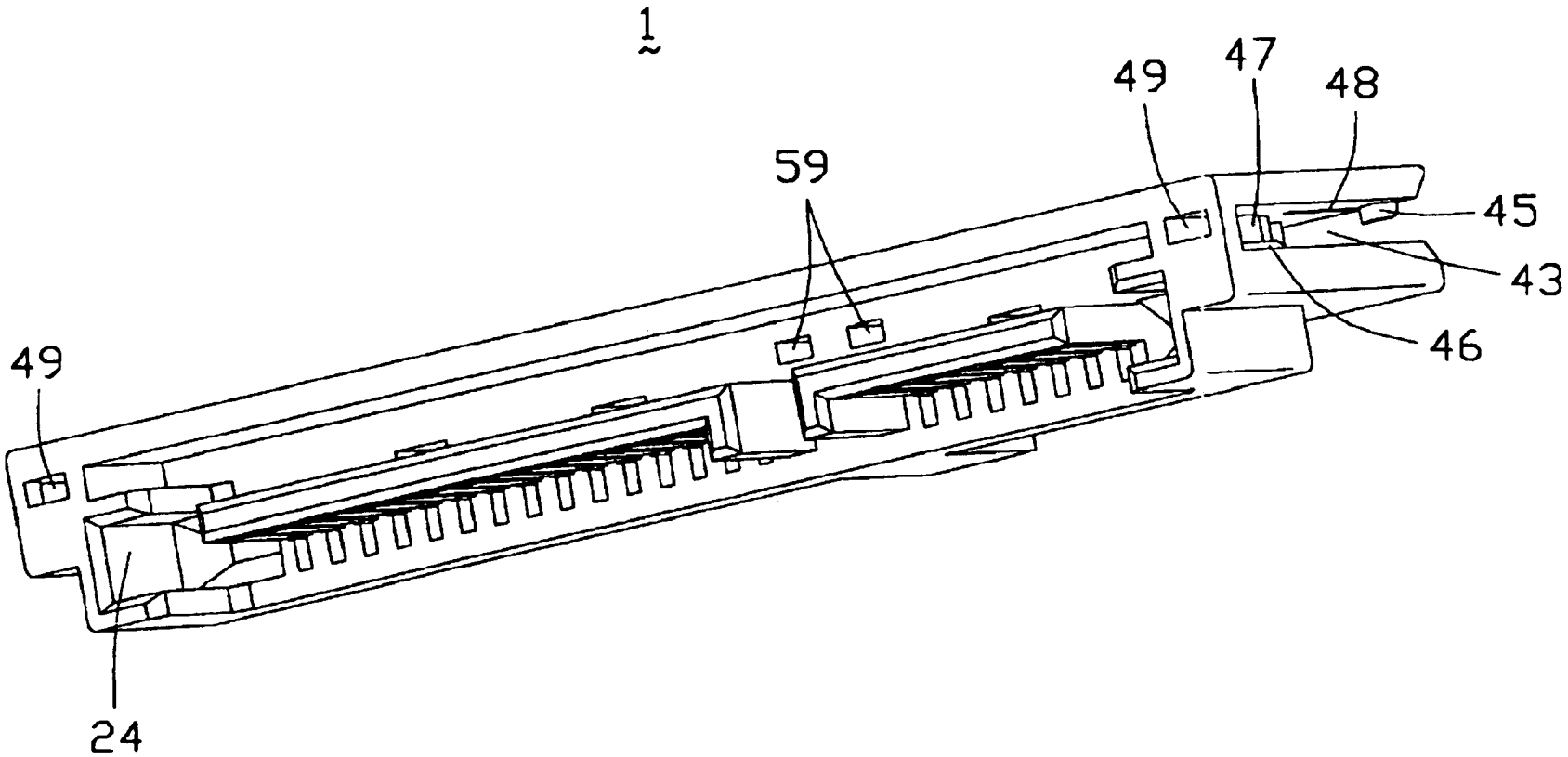
FIG. 4 is a front perspective view of the electrical connector of FIG. 1.

Also referring to FIGS. 3 and 4, a pair of first retainers 40 and a second retainer 50 respectively extends rearwardly from the body portion 14. The first retainer 40 locates below the corresponding guide portion 16 and the second retainer 50 locates between both first retainers 40. The first and second retainers 40, 50, each comprise a top latch 42, 52 and a bottom latch 44, 54, and a receiving slot 43, 53 is defined between the top and the bottom latches 42, 52 and 44, 54. The top latch 42 dividually forms two retention ribs 46 extending into the receiving slot 43. The bottom latch 44 forms a locking tab 45 extending into the receiving slot 43 and defines a small slot 48 beside the locking tab 45 to provide flexibility. A first protrusion 47 is formed between the top latch 42 and the bottom latch 44 for being inserted into a first receiving portion 76 defined in an edge of the PCB and a through hole 49 is defined beside the first protrusion 47 defined by molding tool. The top latch 52 forms a pair of locking tabs 55 extending into the receiving slot 53. A second protrusion 57 is formed between the top latch 52 and the bottom latch 54 for being inserted into a second receiving portion 78 defined in the edge of the PCB and a small slit 56 is defined between the second protrusion 57 and the top latch 52 for providing flexibility. A gap 51 is defined between the top latch 52 and the body portion 14 which can provide the latches more flexible. Also, a pair of through holes 59 is defined at a pair of sides of the second protrusion 57.

Referring to FIGS. 5 to 11, the electrical connector 1 is assembled the edge of the PCB 7. The first retainers 40 and the second retainer 50 fix the PCB 7 and the contacts 12 are electrically connected with the PCB 7. The PCB 7 defines two first small holes 72 at the edge thereof corresponding to the locking tabs 45 and a pair of second small holes 74 in the middle of the edge corresponding to the locking tabs 55 and between the two first small holes 72. The locking tabs 45 of the first retainer 40 are respectively inserted into the first small holes 72 of the PCB 7 and the locking tabs 55 of the second retainer 50 also respectively lock the second small holes 74 of the PCB 7. The first protrusions 47 of the first retainer 40 respectively enter into the first receiving portions 76 of the PCB 7 and the second protrusions 57 of the second retainer 40 also enter into the second receiving portions 78. The retention ribs 46 of the first retainer 40 can push the PCB 7 tightly and keep the PCB 7 and the electrical connector 1 steadily assemble together. Thus, the electrical connector 1 can have a facilitating and steady mounting of the electrical connector onto the PCB 7. Also, because the two retainers 40, 50 of the electrical connector 1 are all plastic and the electrical connector 1 has no extra metal latches used for retaining the PCB 7, it can provide more flexible to avoid damaging and reduce cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for being mounted to an edge of a printed circuit board (PCB), comprising:

an insulative housing having an elongated body portion, a mating portion projecting forwardly from the body portion adapted for engaging with a complementary connector and defining a plurality of recesses therein, a pair of guide portions formed on a pair of lateral sides of the body portion, and a pair of first retainers respectively extending rearwardly from the body portion, the first retainers each defining a receiving slot for receiving the edge of the PCB, a plurality of lacking tabs formed on the first retainers and extending into the receiving slots for engaging into holes defined in the edge of the PCB thereby preventing the PCB moving relative to the housing; and a plurality of contacts assembled to the recesses of the housing;

wherein the insulative housing comprises a second retainer, the first retainers being adjacent to the guide portions and the second retainer locating between both first retainers;

wherein each of the retainers respectively comprises a top portion and a bottom portion, the receiving slot is defined between the top and bottom portions;

wherein a second protrusion is formed on the second retainer and located between the top portion and the bottom portion for being inserted into a second receiving portion defined in the edge of the PCB thereby preventing the PCB moving transversely; and wherein said second retainer comprises a small slit defined between the second protrusion and a bottom surface of the top portion for providing elasticity between the top and bottom portions.

2. The electrical connector as described in claim 1, wherein the locking tab is respectively formed on the bottom portion of the first retainers.

3. The electrical connector as described in claim 1, wherein the bottom portion of the first retainer further defines a small slot extending therethrough and beside the locking tab thereof for providing flexibility.

4. The electrical connector as described in claim 1, wherein a first protrusion is formed on the first retainer and locates between the top portion and the bottom portion for being inserted into a first receiving portion defined in the edge of the PCB thereby preventing the PCB moving transversely.

5. The electrical connector as described in claim 1, wherein the locking tab is formed on the top portion of the second retainer.

6. The electrical connector as described in claim 1, wherein the top portion of the second retainer defines a gap extending horizontally to the body portion to make the top portion more flexible.

7. An electrical connector adapted for being mounted to an edge of a printed circuit board (PCB), comprising:

an insulative housing having an elongated body portion, a mating portion projecting forwardly from the body portion adapted for engaging with a complementary connector and defining a plurality of recesses therein, a pair of guide portions formed on a pair of lateral sides of the body portion, and a pair of first retainers respectively extending rearwardly from the body portion, the first retainers each defining a receiving slot for receiving the edge of the PCB, a plurality of retention ribs formed on the first retainers and extending into the receiving slots for pushing the PCB tightly and keeping the PCB and the electrical connector steadily assemble together; and a plurality of contacts assembled to the recesses of the housing;

wherein the insulative housing comprises a second retainer, the first retainers being adjacent to the guide portions and the second retainer locating between bath first retainers;

wherein said second retainer comprises a small slit defined between the second protrusion and a bottom surface of the top portion for providing elasticity between the top and bottom portions;

wherein a plurality of locking tabs are formed on the first retainers and extended into the receiving slots for engaging into holes defined in the edge of the PCB; and wherein the retention ribs are separately formed on the top portion of the first retainer.

8. The electrical connector as described in claim 7, wherein each of said first retainers includes top and bottom portions, and the retention rib is formed on one of said top and bottom portions and a small slot is formed in the other of said top and bottom portions.

* * * * *